US010760294B1

(12) United States Patent
Pulizzi

(10) Patent No.: US 10,760,294 B1
(45) Date of Patent: Sep. 1, 2020

(54) SAFETY APPARATUS

(71) Applicant: Peter Pulizzi, Temecula, CA (US)

(72) Inventor: Peter Pulizzi, Temecula, CA (US)

( * ) Notice: Subject to any disclaimer, the term of this patent is extended or adjusted under 35 U.S.C. 154(b) by 0 days.

(21) Appl. No.: 16/795,476

(22) Filed: Feb. 19, 2020

Related U.S. Application Data

(63) Continuation of application No. 16/231,434, filed on Dec. 22, 2018, now Pat. No. 10,604,957.

(51) Int. Cl.

| | |
|---|---|
| ***E04H 12/22*** | (2006.01) |
| ***G09F 7/10*** | (2006.01) |
| ***E04H 17/22*** | (2006.01) |
| *E04H 17/00* | (2006.01) |

(52) U.S. Cl.
CPC ..... *E04H 12/2292* (2013.01); *E04H 12/22* (2013.01); *E04H 17/22* (2013.01); *G09F 7/10* (2013.01); *E04H 2017/006* (2013.01)

(58) Field of Classification Search
CPC ..... E04H 12/00; E04H 12/22; E04H 12/2292; E04H 2017/006; E04H 17/20; E04H 17/22; G09F 7/10; Y10T 29/53657
See application file for complete search history.

(56) References Cited

U.S. PATENT DOCUMENTS 2,723,107 A * 11/1955 Parker ..... E04H 17/20 256/24
3,250,050 A * 5/1966 Finger ..... E04H 12/00 52/301
3,319,328 A * 5/1967 Finger ..... H02G 7/00 29/423
3,955,801 A * 5/1976 Soriero, Jr. ..... E04H 17/1413 256/65.13
4,369,953 A * 1/1983 Greiner ..... E04H 17/143 256/24
5,755,431 A * 5/1998 Williams ..... E04H 12/2215 248/523
5,853,167 A * 12/1998 West ..... E04H 17/20 256/66
5,956,875 A * 9/1999 Aughenbaugh ..... G09F 15/0075 256/48
6,021,614 A * 2/2000 Krieger ..... E04H 12/04 52/301
6,543,750 B1 * 4/2003 Calzone ..... E04H 17/20 256/1

(Continued)

*Primary Examiner* — Jessie T Fonseca
(74) *Attorney, Agent, or Firm* — Gulf Coast Intellectual Property Group

(57) ABSTRACT

A safety cover configured to be releasably secured to an exposed portion of a construction element so as to provide improved visibility thereof and provide impalement protection. The safety cover includes a body having an upper portion and a lower portion. The upper portion and lower portion of the body are integrally formed wherein the lower portion of the body extends downward from the lower surface of the upper portion. The lower portion of the body includes three receiving members equidistantly positioned along the width of the upper portion. The three receiving members include walls forming a cavity having an opening operable to provide access thereto. The upper portion further has a top member superposed thereon. Furthermore, a cap member is superposed the upper portion of the body with the top member being intermediate the upper portion and the cap member.

11 Claims, 4 Drawing Sheets

(56) References Cited

U.S. PATENT DOCUMENTS 6,612,551 B1* 9/2003 Roy ..... E04H 17/12 256/1
2002/0104985 A1* 8/2002 Lesenskyj ..... E04H 17/1439 256/65.1
2002/0125468 A1* 9/2002 Fischer ..... E04H 17/20 256/19
2002/0148183 A1* 10/2002 Grant ..... F21S 8/081 52/300
2003/0066992 A1* 4/2003 Burkart ..... E04H 17/20 256/1
2003/0106273 A1* 6/2003 Neylon ..... E04H 17/20 52/244
2005/0035339 A1* 2/2005 Steffes ..... E04H 17/20 256/1
2005/0247920 A1* 11/2005 Burkart ..... E04H 17/20 256/1
2006/0033091 A1* 2/2006 Fattori ..... B29C 65/08 256/19
2008/0149786 A1* 6/2008 Bradley ..... E04H 12/2253 248/121
2008/0265229 A1* 10/2008 DiMartino ..... E04H 17/20 256/1
2012/0018692 A1* 1/2012 Langenwalter ..... E04H 17/1443 256/65.12
2013/0126068 A1* 5/2013 Fattori ..... B29C 65/08 156/73.1
2015/0137058 A1* 5/2015 Platt ..... E04H 17/22 256/65.14
2015/0240515 A1* 8/2015 Davis ..... E04H 17/20 256/1
2017/0211290 A1* 7/2017 Lupton ..... E04H 12/2292
2018/0245301 A1* 8/2018 Herdman ..... E04H 12/00
2018/0266119 A1* 9/2018 Schneider ..... E04F 11/1817
2018/0355632 A1* 12/2018 Nickelston ..... E01F 15/143
2019/0128016 A1* 5/2019 Geise ..... E04H 17/20

* cited by examiner

SAFETY APPARATUS

CROSS REFERENCE TO RELATED APPLICATIONS

This application is a continuation-in-part of U.S. patent application Ser. No. 16/231,434 filed, Dec. 22, 2018, entitled, Safety Apparatus, issued as U.S. Pat. No. 10,604,957, which is hereby incorporated for reference.

FIELD OF THE INVENTION

The present invention relates generally to safety apparatus, more specifically but not by way of limitation, a safety cover utilized in the field of construction wherein the safety cover is operable to be releasably secured to an exposed portion of a column support or similar item that presents a safety hazard and is either required or desirable to provide coverage thereof so as to prevent injuries to workers.

BACKGROUND

Construction projects range in scope and scale from a simple remodel to new construction of a commercial facility. Numerous types of construction techniques are employed depending upon parameters such as but not limited to the application and code requirements. Concrete foundations are commonly used in applications that range from the addition of a deck or space to a residential construction to the construction of a large commercial facilities. Foundations are structurally secured to walls and other building elements utilizing various techniques and fasteners. It is necessary to provide a structural bond intermediate the foundation and building support elements such as but not limited to posts. Post connectors also referred to as column base connectors provide a structural coupling between the foundation and construction elements such as but not limited to structural columns, walls and similar construction elements. The conventional column base connector includes a portion that is embedded in a foundation wherein the column base connector includes a portion embedded in the concrete/foundation and further includes an upper portion that extends upward from the concrete and/or foundation. The upper portion is configured to be mechanically coupled to a support post or similar element utilizing suitable durable mechanical techniques.

One issue presented during installation of the column base connectors is the exposure of their upper portion subsequent installation thereof. The exposed upper portions of the column base connectors create significant safety hazards on the construction site. Some construction sites utilize hundreds of column base connectors and as various trades perform their portion of the construction project, the exposed upper portions of the column base connectors present hazards such as but not limited to tripping hazards. Furthermore, these exposed column base connectors create safety hazards wherein an individual can suffer from lacerations and impalement and other workplace injuries leading to increased liability for the builder and risk for the workers on the job site.

Accordingly, there is a need for a safety cover for column base connectors and/or post mounts that can be releasably secured thereto and reduce the safety hazard risk presented thereby.

SUMMARY OF THE INVENTION

It is the object of the present invention to provide a safety cover for a column base connector wherein the safety cover is configured to be releasably secured to the upper portion of the column base connector that is exposed ensuing installation thereof.

Another object of the present invention is to provide a safety cover to prevent injuries on a job site from exposed column base connectors wherein the safety cover includes a body having an upper portion and a lower portion.

A further object of the present invention is to provide a safety cover for a column base connector wherein the safety cover is configured to be releasably secured to the upper portion of the column base connector wherein the upper portion and lower portion of the body of the base connector are perpendicular in orientation.

Still another object of the present invention is to provide a safety cover to prevent injuries on a job site from exposed column base connectors wherein the upper portion of the body is planar in manner.

An additional object of the present invention is to provide a safety cover for a column base connector wherein the safety cover is configured to be releasably secured to the upper portion of the column base connector wherein the lower portion extends downward from the bottom surface of the upper portion.

Yet a further object of the present invention is to provide a safety cover to prevent injuries on a job site from exposed column base connectors wherein the lower portion includes three receiving members wherein each receiving member is configured to be releasably secured to an exposed portion of a column base connector.

Another object of the present invention is to provide a safety cover for a column base connector wherein the safety cover is configured to be releasably secured to an exposed portion of a column base connector wherein the three receiving members of the lower portion are equally distributed across the body of the upper portion.

Still a further object of the present invention is to provide a safety cover to prevent injuries on a job site from exposed column base connectors wherein the centrally located receiving member includes an aperture penetrating opposing sidewalls.

Yet another object of the present invention is to provide a safety cover for a column base connector wherein the upper portion includes a tope member secured to the upper surface thereof.

An additional object of the present invention is to provide a safety cover to prevent injuries on a job site from exposed column base connectors wherein the top member further includes a cap member configured to cover the top member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
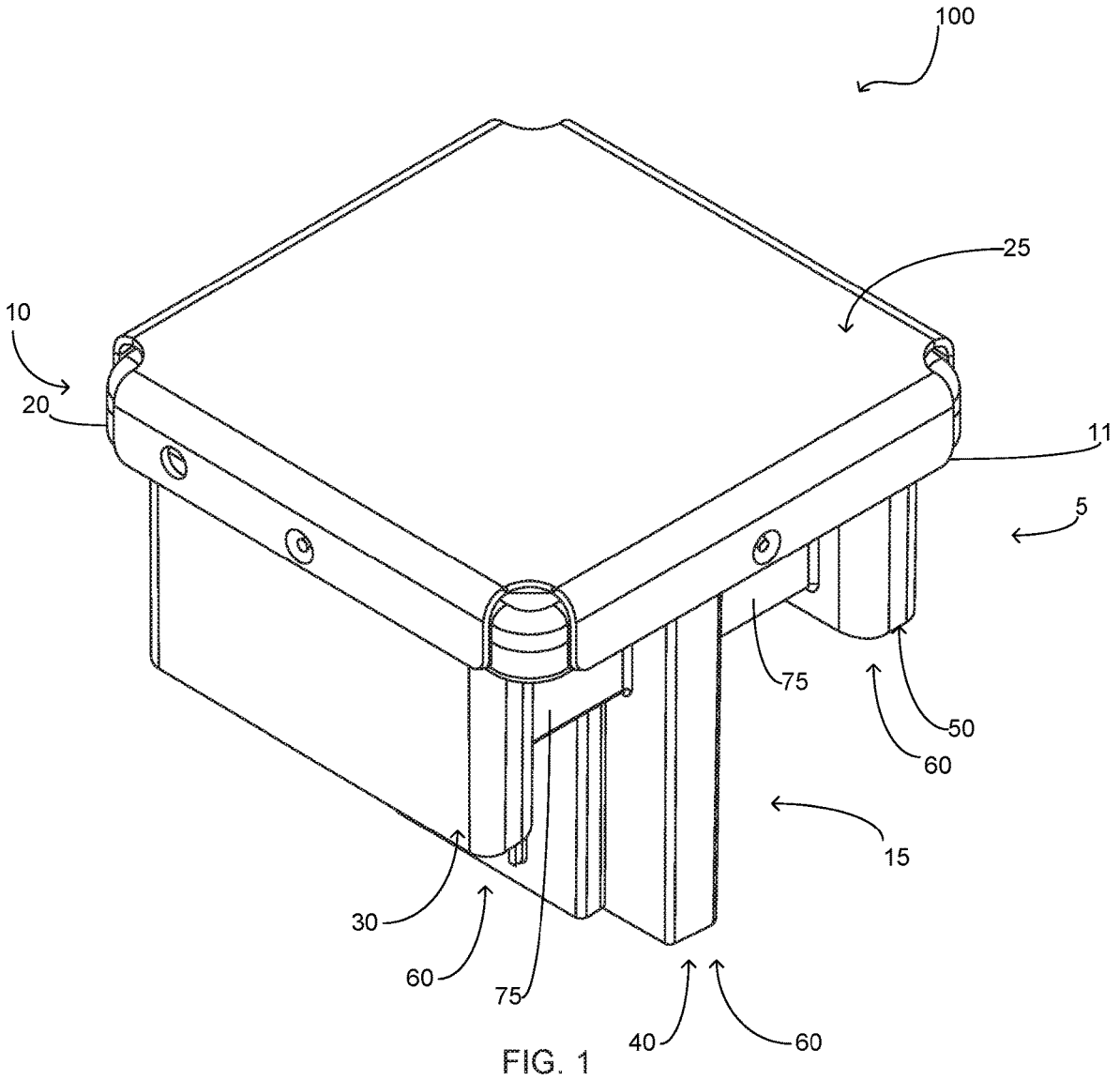
FIG. 1 is a perspective view of the present invention.

Referring now to the drawings submitted herewith, wherein various elements depicted therein are not necessarily drawn to scale and wherein through the views and figures like elements are referenced with identical reference numerals, there is illustrated a safety cover 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures herein, the safety cover 100 further includes a body 5 manufactured from a durable suitable material such as but not limited to plastic. The body 5 includes an upper portion 10 and a lower portion 15 contiguously formed. While no specific color of the body 5 is required, it is desired within the scope of the present invention that the body 5 is manufactured in a high visibility color such as but not limited to yellow or orange. The body 5 is manufactured utilizing suitable durable techniques such as but not limited to injection molding. The upper portion 10 of the body 5 is square in shape and is planar in manner having a peripheral edge 11 defining the shape thereof. The upper portion 10 includes upper surface 12 and lower surface 13. Surroundably present on the lower surface 13 is lip member 20. Lip member 20 extends downward from lower surface 13. It is contemplated within the scope of the present invention that the lip member 20 could extend downward in various lengths and functions to provide lower perimeter protection for the upper portion 10 of the body 5. While the upper portion 10 is illustrated herein as being square in shape, it is contemplated within the scope of the present invention that the upper portion 10 could be formed in alternate shapes and sizes.

The upper portion 10 has superposed thereon a top member 22. Top member 22 is planar in manner and is manufactured to have a similar shape and size of the upper surface 12 of the upper portion 10. The top member 22 substantially covers the upper surface 12 and is secured thereto utilizing suitable durable techniques such as but not limited to chemical adhesion. The top member 22 is manufactured from a rigid material such as but not limited to metal. The top member 22 is utilized to provide additional impalement protection in more hazardous work environments. Being manufactured of metal, the top member 22 serves to substantially inhibit the ability for a portion of a base column connector or other construction item to which the safety cover is secured from penetrating completely through the upper portion 10. This ensures protection during instances wherein contact with the safety cover 100 occurs with a greater force and as such could result in the comprise of the upper surface 12 of the upper portion 10. It is contemplated within the scope of the present invention that the top member 22 could be manufactured in various thickness so as to provide the ability to inhibit penetration of a construction element therethrough.

Figure 4:
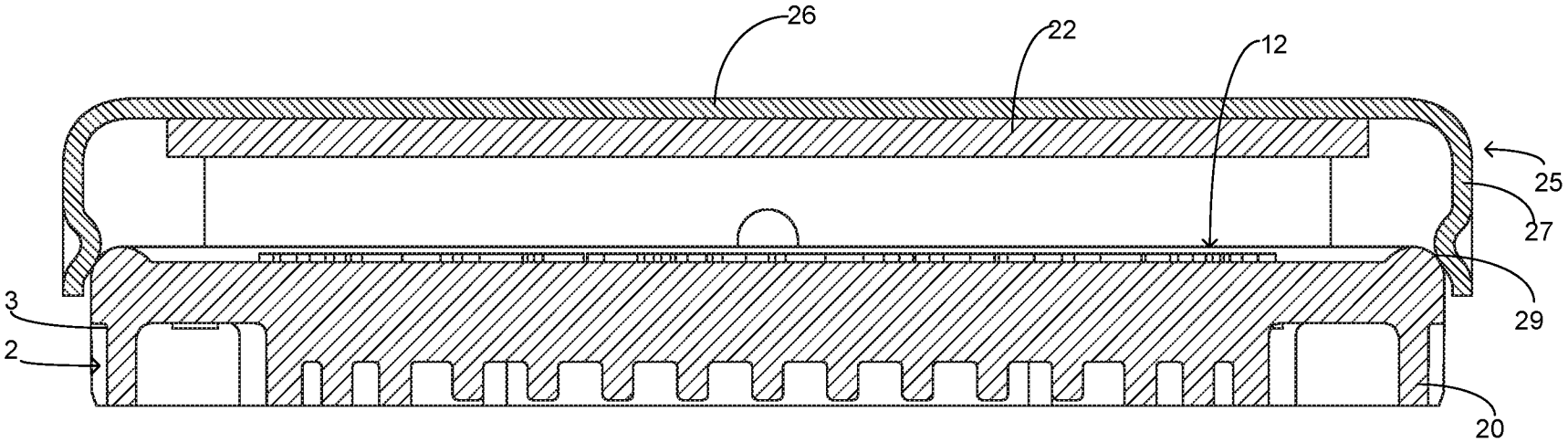
FIG. 4 is cross sectional view of the top member of the present invention with cap member in a pre-assembly position.
Figure 5:
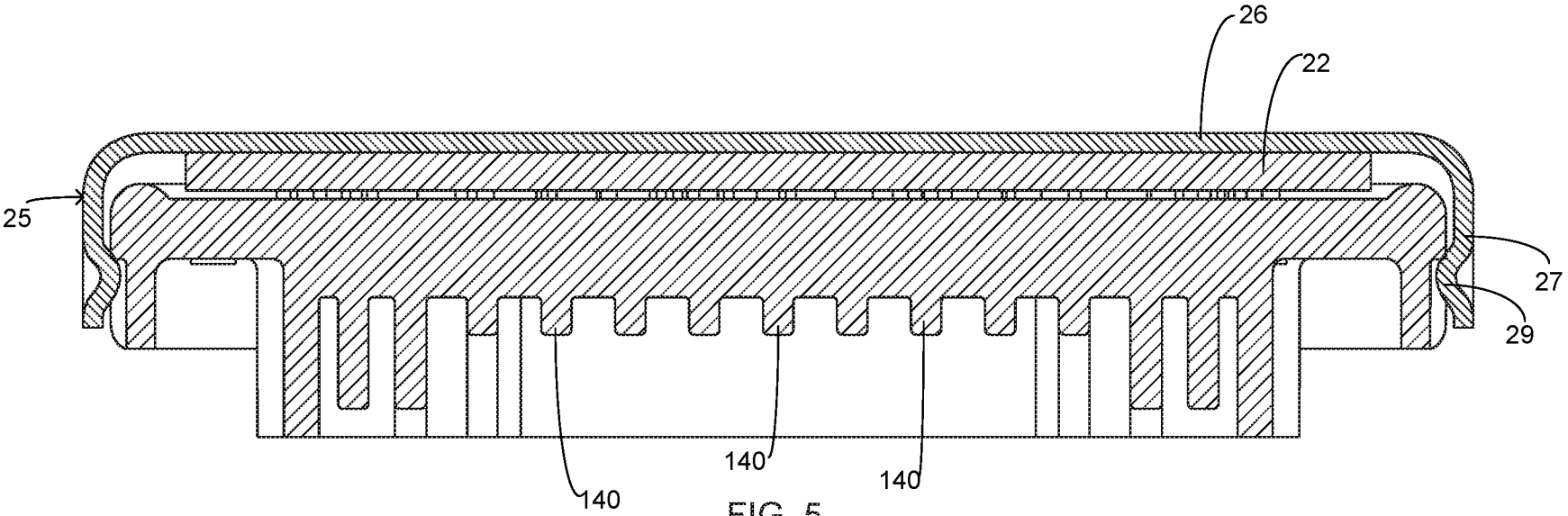
FIG. 5 is a cross-sectional view of the top member of the present invention with the cap member in its assembled position.
Figure 6:
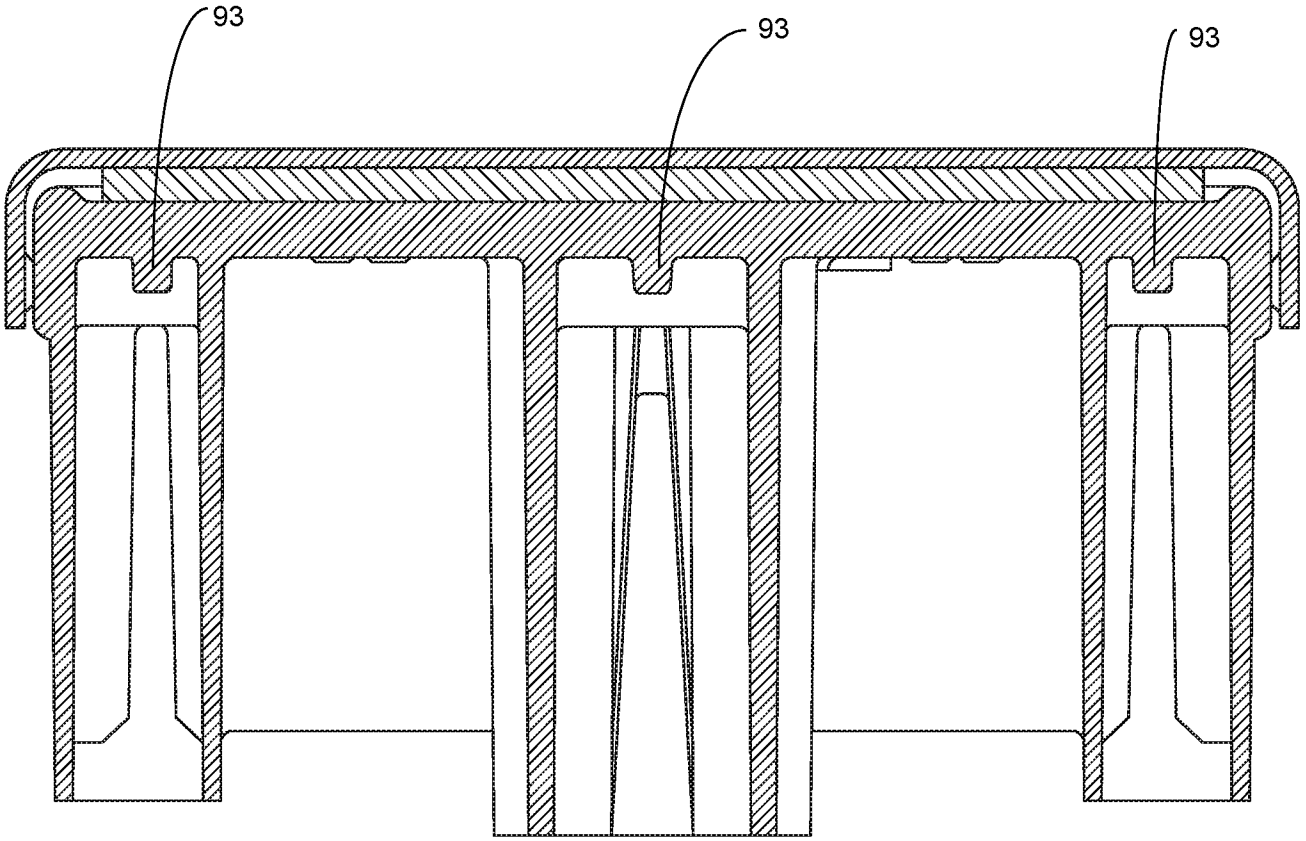
FIG. 6 is a cross-sectional end view of the present invention.

The upper portion 10 has secured thereto a cap member 25. The cap member 25 is illustrated herein in FIG. 4 and FIG. 5. In FIG. 4 the cap member 25 is illustrated in a pre-assembly position and in FIG. 5 the cap member 25 is shown in its assembled position wherein the cap member 25 is secured to the upper portion 10. The cap member 25 includes a side wall 27 that is perpendicular to the top wall 26 and extends downward therefrom on all sides of the cap member 25. The side wall 27 has formed therein proximate the lower perimeter edge 28 a mounting tab 29. Mounting tab 29 is contiguously formed with the side wall 27 and is formed so as to have an arcuate shape that is oriented inwards toward the upper portion 10. The mounting tab 29 is configured to secure to the upper portion 10 via biased engagement with inset portion 2 of lip member 20. The mounting tab 29 biases inward on the inset portion 2 and in combination with edge 3 provides retention of the position of the cap member 25. It should be understood within the scope of the present invention that the mounting tab 29 could be formed in alternate shapes and/or sizes and still achieve the desired objective discussed herein. The cap member 25 provides an additional technique to ensure the top member 22 maintains its position.

The lower portion 15 of the body 5 includes a first receiving member 30, a second receiving member 40 and a third receiving member 50. The receiving members 60 function to provide a technique to releasably secure the safety apparatus 100 to base column connector (not illustrated herein) or similar construction element. As is further discussed herein, the arrangement of the receiving members 60 provide alternate techniques of releasably securing to various exposed portions of column base connectors or similar elements. The receiving members 60 are all similarly formed having a plurality of walls 71 that are contiguously formed to create cavities 80. Cavities 80 are hollow and are configured to have disposed therein a portion of an exposed column base connector or similar element subsequent installation thereof. Each receiving member 60 has an opening 85 that provides access to the cavities 80. The openings 85 are of suitable size to accommodate various sizes of portions of exemplary column base connectors or similar elements. While the openings 85 are illustrated herein as being generally rectangular in shape, it is contemplated within the scope of the present invention that the openings 85 and walls 71 could be formed in alternate shapes to provide mateable engagement with alternative types and shapes of base column connectors or similar exposed elements present at a construction site. It is further contemplated within the scope of the present invention that the receiving members 60 could be formed from a single wall member or from a plurality of wall members needed to form a mateable shape so as to be releasably secured to a construction element. Additionally, it is contemplated within the scope of the present invention that the safety cover 100 could have only two receiving members 60 or more than three receiving member 60 as needed to be releasably secured to a construction element to provide improved visibility thereof and environmental safety.

A second receiving member 40 is located intermediate first receiving member 30 and third receiving member 50. The second receiving member 40 is formed so as to have a greater length than that of the first receiving member 30 and third receiving member 50. The greater length of the second receiving member 40 provides a user an option to solely engage the second receiving member 40 with a portion of a column base connector or other exposed construction element. It is contemplated within the scope of the present invention that the second receiving member 40 could be manufactured in various lengths all being greater in length than the length of the first receiving member 30 and third receiving member 50. The second receiving member 40 includes an aperture 91 that is journaled through opposing walls 71. Apertures 91 is formed so as to be in parallel axial alignment so as to receive therethrough a locking member or similar element in order to inhibit unwanted removal of the safety cover 100 from a column base connector or similar construction element. It is contemplated within the scope of the present invention that the first receiving member 30 and third receiving member 50 could also have apertures journaled therethrough so as to provide a similar function as the aforementioned aperture 91.

Formed within the cavities 80 of the first receiving member 30, second receiving member 40 and third receiving member 50 are central rib members 93. The central rib members 93 are contiguously formed utilizing suitable durable techniques. The central rib members 93 are present substantially along the width of the first receiving member 30, second receiving member 40 and third receiving member 50. The central rib members 93 are perpendicular to first rib support members 130 and second rib support members 140 and function in conjunction therewith to inhibit a portion of a column base connector journaled into the first receiving member 30, second receiving member 40 or third receiving member 50 from propagating therethrough. It should be understood within the scope of the present invention that the central rib members 93 could be manufactured in alternate thicknesses.

Integrally formed intermediate the receiving members 60 are support members 75. The support members 75 are integrally formed intermediate the receiving members 60 utilizing suitable durable techniques. The support members 75 are planar in manner and extend intermediate the first receiving member 30 and the second receiving member 40. Support members 75 are further present intermediate the second receiving member 40 and third receiving member 50. The support members 75 provide lateral stability for the receiving members 60. It is contemplated within the scope of the present invention that the safety cover 100 could have as few as one support member 75 intermediate each receiving member 60 or more than two support members 75. It is further contemplated within the scope of the present invention that the support members 75 extend downward along the receiving members 60 a distance that is at least fifty percent of the length of the receiving members 60 in order to provide the desired structural support.

Figure 2:
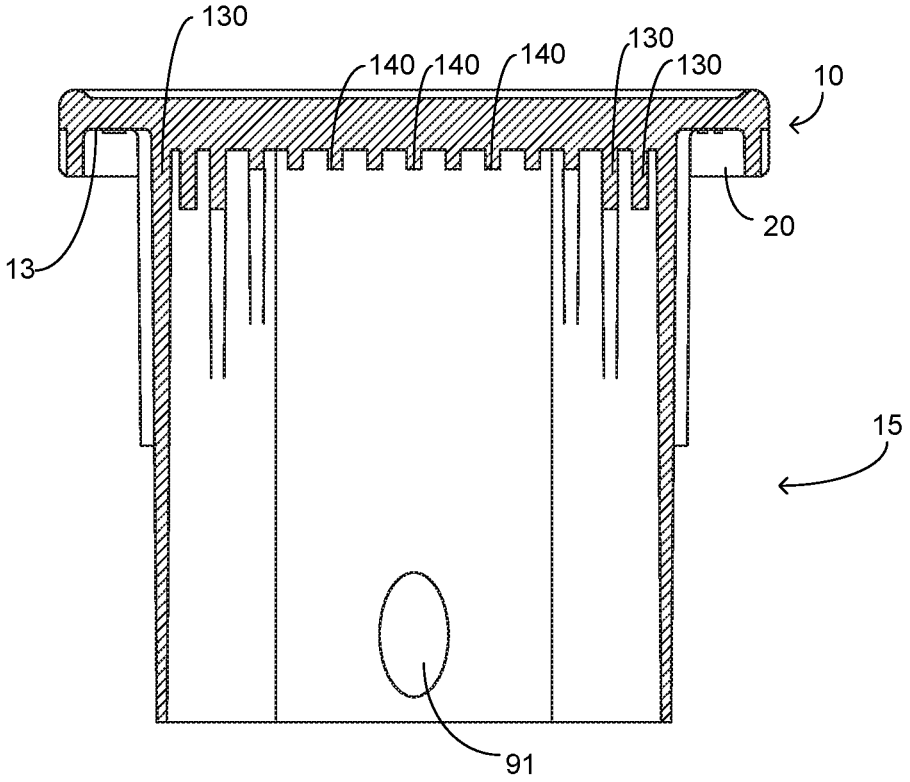
FIG. 2 is a cross sectional view of the present invention.
Figure 3:
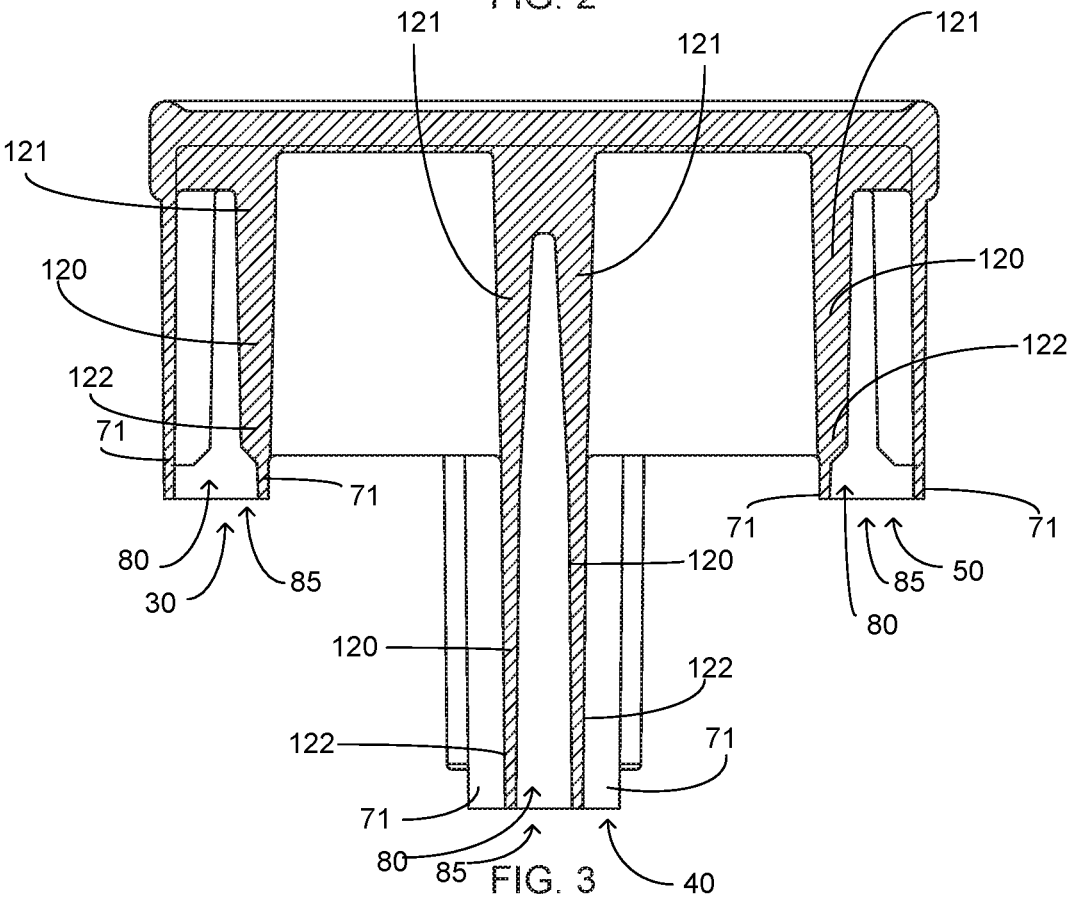
FIG. 3 is a cross sectional end view of the present invention.

Referring now in particular to FIGS. 2 and 3 herein, that safety cover 100 includes within the cavities 80 of the first receiving member 30, the second receiving member 40 and third receiving member 50 retention members 120 that are integrally formed within the cavity 80 on the interior surface thereof. The retention members 120 are molded into the cavities 80 along the interior surface thereof and include a first end 121 and a second end 122. The retention members 120 are formed such that the thickness thereof is tapered from the first end 121 to the second end 122. The thickness of the body 123 is formed such that the retention members 120 are thinner proximate the first end 121 and thicker proximate the second end 122. As a portion of column base connectors or similar construction elements are inserted into the cavities 80 the retention members 120 will engage the sides thereof so as to frictionally engage the portion ensuring a secure connection with the safety cover 100. It is contemplated within the scope of the present invention that the retention members 120 could be manufactured in alternate lengths and further having varying thicknesses.

A plurality of first rib support members 130 and second rib support members 140 are integrally formed within the cavity 80. The first rib support members 130 and second rib support members 140 are present so as to absorb the impact force from column base connectors or similar construction elements when exposed to a downward force from on the safety cover from events such as but not limited to a falling construction worker. The first rib support members 130 and second rib support members 140 are arranged in a linear row with the first rib support members 130 being configured to initially engage the construction element and if a higher force is applied then subsequently the second rib support members will engage the portion 98. Further the top member 22 provides yet an additional safety element to ensure the construction element does not penetrate through the safety cover and injure the worker that has impaled themselves on the safety cover 100. It is contemplated within the scope of the present invention that the safety apparatus 100 could employ just the first rib support members 130 and further employ alternate quantities of the first rib support members 130 and second rib support members 140.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A safety cover configured to be releasably secured to an exposed portion of a construction element subsequent installation thereof comprising:

a body, said body having an upper portion and a lower portion, said upper portion and said lower portion being contiguously formed, said upper portion having an upper surface and a lower surface, said upper portion being planar in manner, said upper portion having a peripheral edge defining the shape thereof, said lower portion extending downward from said lower surface of said upper portion, said lower portion including a first receiving member, a second receiving member and a third receiving member, said first receiving member, second receiving member and third receiving member each being comprised of at least one wall forming a cavity, said cavity configured to have the exposed portion of the construction element journaled the construction wherein said second receiving member is intermediate said first receiving member and said third receiving member and wherein said second receiving member is greater in length than said first receiving member and said third receiving member, said second receiving member further including an aperture, said aperture being formed in said at least one wall of said second receiving member, said aperture operable to facilitate the securing of the safety apparatus to the exposed portion of the construction element, wherein the first receiving member, second receiving member and third receiving member have at least one retention member formed in the cavity thereof;

a top member, said top member being planar in manner, said top member being superposed said upper surface of said upper portion;

at least two support members, said at least two support members extending intermediate said first receiving member and said second receiving member and said third receiving member; and wherein said first receiving member, a second receiving member and a third receiving member are arranged in a parallel manner along the lower surface of the upper portion of said body.

2. The safety cover as recited in claim 1, wherein said at least two support members extend downward from said lower surface of said upper portion of said body.

3. The safety cover as recited in claim 2, wherein the first receiving member, second receiving member and third receiving member further include at least one support rib member formed in the cavity thereof.

4. The safety cover as recited in claim 3, that further includes at least one support rib perpendicular to a plurality of support ribs wherein the plurality of support ribs are axially aligned.

5. The safety cover as recited in claim 4, wherein the top member is manufactured from metal.

6. The safety cover as recited in claim 5, and further including a cap member, said cap member configured to be superposed the upper portion of the body.

7. A safety cover configured to be releasably secured to an exposed portion of a construction element subsequent installation thereof comprising:

a body, said body having an upper portion and a lower portion, said upper portion and said lower portion being contiguously formed, said upper portion having an upper surface and a lower surface, said upper portion being planar in manner, said upper portion having a peripheral edge defining the shape thereof, said lower portion extending downward from said lower surface of said upper portion, said lower portion including a first receiving member, a second receiving member and a third receiving member, said first receiving member, second receiving member and third receiving member each being comprised of at least one wall forming a cavity, said cavity configured to have the exposed portion of the construction element journaled the construction wherein said second receiving member is intermediate said first receiving member and said third receiving member and wherein said second receiving member is greater in length than said first receiving member and said third receiving member, said second receiving member further including an aperture, said aperture being formed in said at least one wall of said second receiving member, said aperture operable to facilitate the securing of the safety apparatus to the exposed portion of the construction element, wherein the first receiving member, second receiving member and third receiving member have at least one retention member formed in the cavity thereof;

a top member, said top member being planar in manner, said top member being superposed said upper surface of said upper portion and being mateably shaped therewith, said top member being manufactured from metal;

at least two support members, said at least two support members extending intermediate said first receiving member and said second receiving member and said third receiving member;

a cap member, said cap member being superposed said upper portion of said body, said cap member having a top wall and a side wall extending downward therefrom, said cap member being mateably shaped with said upper portion of said body; and wherein said first receiving member, a second receiving member and a third receiving member are arranged in a parallel manner along the lower surface of the upper portion of said body.

8. The safety cover as recited in claim 7, wherein the side wall of the cap member further includes a mounting tab, said mounting tab configured to facilitate engagement with said upper portion of said body so as to secure said cap member thereto.

9. The safety cover as recited in claim 8, wherein said mounting tab is contiguously formed with the side wall of said cap member and are arcuate in form and further oriented inwards toward said upper portion of said body.

10. The safety cover as recited in claim 9, wherein said upper portion further includes an inset portion, said inset portion configured to operably engage said mounting tab so as to secure said cap member.

11. The safety cover as recited in claim 10, wherein said first receiving member, said second receiving member and said third receiving member further include a central rib member, said central rib member being proximate the upper portion of the body, said central rib member being disposed within said cavity of said first receiving member, said second receiving member and said third receiving member.

* * * * *